US010925793B2

(12) United States Patent
Sepulveda

(10) Patent No.: US 10,925,793 B2
(45) Date of Patent: Feb. 23, 2021

(54) SPINE ALIGNMENT AND DECOMPRESSION SYSTEMS

(71) Applicant: Homero Sepulveda, Kingwood, TX (US)

(72) Inventor: Homero Sepulveda, Kingwood, TX (US)

( * ) Notice: Subject to any disclaimer, the term of this patent is extended or adjusted under 35 U.S.C. 154(b) by 783 days.

(21) Appl. No.: 15/627,870

(22) Filed: Jun. 20, 2017

(65) Prior Publication Data

US 2017/0360642 A1 Dec. 21, 2017

Related U.S. Application Data

(60) Provisional application No. 62/352,203, filed on Jun. 20, 2016.

(51) Int. Cl.
*A61H 1/00* (2006.01)
*A61H 23/00* (2006.01)
(Continued)

(52) U.S. Cl.
CPC ..... *A61H 1/005* (2013.01); *A47C 7/38* (2013.01); *A47C 7/46* (2013.01); *A61H 1/001* (2013.01);
(Continued)

(58) Field of Classification Search
CPC .. A47C 7/38; A47C 7/46; A61H 23/02; A61H 37/00; A61H 2201/0107; A61H 2201/0138; A61H 2201/0165; A61H 2201/0176; A61H 2201/0192; A61H 2201/1607; A61H 2201/1626; A61H 2201/1635; A61H 2201/1642;
(Continued)

(56) References Cited

U.S. PATENT DOCUMENTS 2,893,380 A * 7/1959 Patrea ..... A61H 1/0214 601/24
2,937,641 A * 5/1960 Oetinger ..... A47C 1/143 601/59
(Continued)

FOREIGN PATENT DOCUMENTS

DE 2552777 A1 * 6/1977 ..... A61H 1/02

OTHER PUBLICATIONS

English Translation for DE 2552777, espacenet.com, translated on Oct. 19, 2020.*

*Primary Examiner* — Tu A Vo
(74) *Attorney, Agent, or Firm* — Smith & Woldesenbet Law Group, PLLC

(57) ABSTRACT

A system can include a base configured to support a lower half of a human body. The system can also include a headrest elevated relative to the base, wherein the headrest is disposed adjacent to a proximal end of the base, where the headrest is configured to support a head of the human body. The system can further include a back platform having a first end and a second end, where the first end is coupled to the base, where the second end is disposed adjacent to the headrest, and where the back platform has a curvature, where the back platform is configured to support a torso of the human body. The system can also include a vibrating mechanism in communication with the back platform, where vibrations generated by the vibrating mechanism translate to the back platform.

15 Claims, 7 Drawing Sheets

(51) Int. Cl.

| | |
|---|---|
| ***A47C 7/38*** | (2006.01) |
| ***A47C 7/46*** | (2006.01) |
| ***A61H 23/02*** | (2006.01) |
| ***A61H 37/00*** | (2006.01) |

(52) U.S. Cl.
CPC ..... *A61H 23/02* (2013.01); *A61H 37/00* (2013.01); *A61H 2201/0107* (2013.01); *A61H 2201/0138* (2013.01); *A61H 2201/0165* (2013.01); *A61H 2201/0176* (2013.01); *A61H 2201/0192* (2013.01); *A61H 2201/1607* (2013.01); *A61H 2201/1626* (2013.01); *A61H 2201/1635* (2013.01); *A61H 2201/1642* (2013.01); *A61H 2201/1685* (2013.01); *A61H 2201/1695* (2013.01); *A61H 2201/5005* (2013.01); *A61H 2201/5043* (2013.01); *A61H 2201/5058* (2013.01); *A61H 2201/5061* (2013.01); *A61H 2201/5097* (2013.01); *A61H 2203/0456* (2013.01); *A61H 2205/02* (2013.01); *A61H 2205/081* (2013.01); *A61H 2230/80* (2013.01)

(58) Field of Classification Search
CPC .... A61H 2201/1685; A61H 2201/1695; A61H 2201/5005; A61H 2201/5043; A61H 2201/5058; A61H 2201/5061; A61H 2201/5097; A61H 2203/0456; A61H 2205/02; A61H 2205/081; A61H 2230/80
See application file for complete search history.

(56) References Cited

U.S. PATENT DOCUMENTS

| | | | | | |
|---|---|---|---|---|---|
| 3,113,567 | A | | 12/1963 | Russell | |
| 4,173,972 | A | * | 11/1979 | Kodera | A61H 7/004 601/102 |
| 4,546,764 | A | * | 10/1985 | Gerber | A61G 13/009 601/108 |
| 4,736,735 | A | * | 4/1988 | Yong | A61H 23/0218 601/59 |
| 5,020,518 | A | * | 6/1991 | Spears | A61H 15/0078 601/102 |
| 5,020,520 | A | | 6/1991 | Lawlis | |
| 6,106,490 | A | * | 8/2000 | Shaw | A61H 1/0229 482/142 |
| 6,319,213 | B1 | * | 11/2001 | Tomac | A61H 1/00 601/49 |
| 6,468,236 | B1 | * | 10/2002 | Sumanac | A63B 23/0211 601/49 |
| 6,681,770 | B1 | * | 1/2004 | Dreher | A61H 1/008 128/845 |
| 7,575,541 | B2 | * | 8/2009 | Chen | A61H 1/0218 482/143 |
| 2004/0236256 | A1 | | 11/2004 | Kim | |
| 2007/0239089 | A1 | * | 10/2007 | Chiu | A61H 7/007 601/99 |
| 2008/0139979 | A1 | * | 6/2008 | Talish | A61H 1/001 601/51 |
| 2009/0124940 | A1 | * | 5/2009 | Nishio | A61H 15/0078 601/49 |
| 2010/0056964 | A1 | * | 3/2010 | Summers | A61H 7/001 601/49 |
| 2010/0236560 | A1 | | 9/2010 | Rambo et al. | |
| 2011/0125070 | A1 | * | 5/2011 | Lu | A61H 1/0292 601/115 |
| 2012/0065558 | A1 | | 3/2012 | Abercrombie, III | |
| 2012/0167311 | A1 | * | 7/2012 | Lee | A61H 23/0254 5/694 |
| 2013/0226051 | A1 | * | 8/2013 | Lu | A61H 7/007 601/99 |
| 2013/0253582 | A1 | * | 9/2013 | Tielve | A61B 17/66 606/240 |
| 2016/0243395 | A1 | * | 8/2016 | Ban | A61H 9/0078 |

* cited by examiner

SPINE ALIGNMENT AND DECOMPRESSION SYSTEMS

CROSS-REFERENCE TO RELATED APPLICATIONS

This application claims priority under 35 U.S.C. § 119 to U.S. Provisional Patent Application Ser. No. 62/352,203, titled "Adjustable, Vibrating Table For Alignment and Decompression of the Spine" and filed on Jun. 20, 2016, the entire contents of which are hereby incorporated herein by reference.

TECHNICAL FIELD

Embodiments described herein relate generally to back relief, and more particularly to systems, methods, and devices for aligning and decompressing the spine.

BACKGROUND

A number of people have various aches and pains in their back. Some of these aches and pains can be derived from poor posture, misalignment of the spine, injury, and other similar ailments. In some cases, relief from back pain can be achieved by properly aligning and/or decompressing the spine.

SUMMARY

In general, in one aspect, the disclosure relates to a system that can include a base configured to support a lower half of a human body. The system can also include a headrest assembly that includes a headrest that is elevated relative to the base, where the headrest is disposed adjacent to a proximal end of the base, where the headrest is configured to support a head of the human body. The system can further include a back platform having a first end and a second end, where the first end is coupled to the base, where the second end is disposed adjacent to the headrest, and where the back platform has a curvature, where the back platform is configured to support a torso of the human body. The system can also include a vibrating mechanism in communication with the back platform, where vibrations generated by the vibrating mechanism translate to the back platform.

These and other aspects, objects, features, and embodiments will be apparent from the following description and the appended claims.

BRIEF DESCRIPTION OF THE DRAWINGS

The drawings illustrate only example embodiments of systems for aligning and decompressing the spine and are therefore not to be considered limiting of its scope, as systems for aligning and decompressing the spine may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
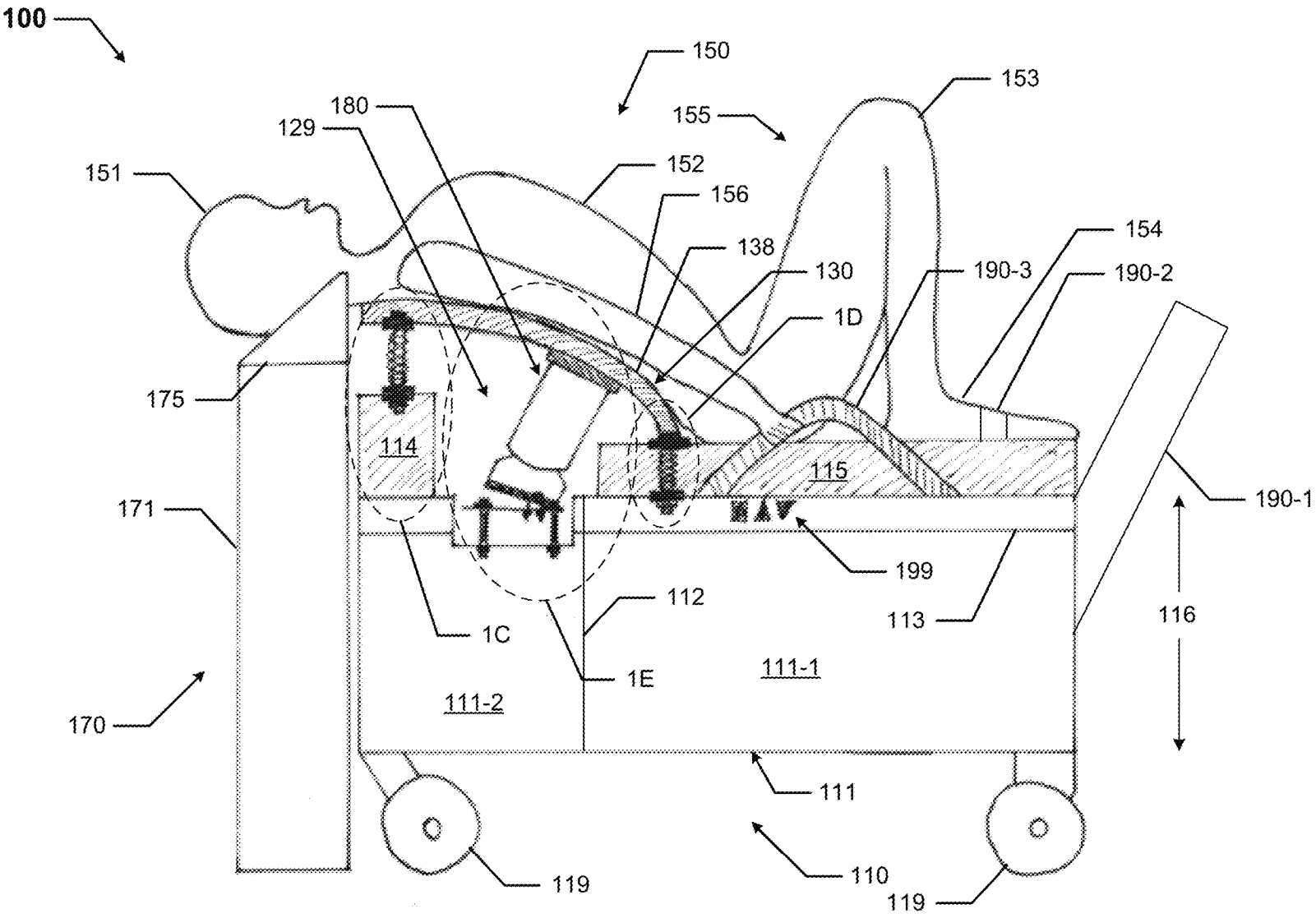
FIGS. 1A-1E show various views of an example system in accordance with certain example embodiments.

The example embodiments discussed herein are directed to systems, apparatuses, and methods of spine alignment and decompression. As described herein, a user can be any person that interacts with spine alignment and decompression systems. Examples of a user may include, but are not limited to, an adult, a juvenile, a personal trainer, a fitness instructor, an athlete, a consultant, a contractor, a sales associate, an injured patient under rehabilitative care, and a manufacturer's representative. A user can be a person disposed on the example system for spine alignment and decompression. In addition, or in the alternative, a user can be a person who is supervising operation of the example system while another person is disposed on the system.

In one or more example embodiments, a spine alignment and decompression system is subject to meeting certain standards and/or requirements. Examples of entities that set and/or maintain such standards can include, but are not limited to, the Underwriters Laboratories (UL), the Human Factors and Ergonomics Society (HFES), the International Organization for Standardization (ISO), the American Medical Association (AMA), and the Occupational Safety and Health Administration (OSHA). Example embodiments are designed to be used in compliance with any applicable standards and/or regulations.

Any portion of example systems described herein can be made from a single piece or component. Alternatively, example systems (or components or portions thereof) can be made from multiple pieces or components. Further, any example systems (or components or portions thereof) can have any of a number of suitable characteristics (e.g., shapes, sizes, dimensions, firmness, adjustability). Example systems described herein can be used for any of a number of benefits related to the spine, including but not limited to decompression and alignment.

Components and/or features described herein can include elements that are described as coupling, fastening, securing, abutting against, in communication with, or other similar terms. Such terms are merely meant to distinguish various elements and/or features within a component or device and are not meant to limit the capability or function of that particular element and/or feature. For example, a feature described as a "coupling feature" can couple, secure, fasten, abut against, be in communication with, and/or perform other functions aside from strictly coupling. In addition, each component and/or feature described herein (including each component of example systems) can be made of one or more of a number of suitable materials, including but not limited to metal, nylon, spandex, rubber, foam, ceramic, gel, neoprene, and plastic.

A coupling feature (including a complementary coupling feature) as described herein can allow one or more components and/or portions of an example system to become coupled, directly or indirectly, to another portion of the system. A coupling feature can include, but is not limited to, a clamp, a portion of a hinge, an aperture, a recessed area, a protrusion, a slot, a spring clip, a tab, a detent, stitching, and mating threads. One portion of an example system can be coupled to another portion of the system by the direct use of one or more coupling features.

In addition, or in the alternative, a portion of an example system can be coupled to another portion of the system using one or more independent devices that interact with one or more coupling features disposed on a component of the system. Examples of such devices can include, but are not limited to, a pin, a hinge, a fastening device (e.g., a bolt, a screw, a rivet), and a spring. One coupling feature described herein can be the same as, or different than, one or more other coupling features described herein. A complementary coupling feature as described herein can be a coupling feature that mechanically couples, directly or indirectly, with another coupling feature.

In the foregoing figures showing example embodiments of systems for spine alignment and decompression, one or more of the components shown may be omitted, repeated, and/or substituted. Accordingly, example embodiments of systems for spine alignment and decompression should not be considered limited to the specific arrangements of components shown in any of the figures. For example, features shown in one or more figures or described with respect to one embodiment can be applied to another embodiment associated with a different figure or description.

In addition, if a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component.

For example, for purposes of present or future claims herein, a feature or component that is described as not being included in an example embodiment shown in one or more particular drawings is capable of being included in one or more claims that correspond to such one or more particular drawings herein. The numbering scheme for the various components in the figures herein is such that each component is a three digit number, and corresponding components in other figures have the identical last two digits.

Example embodiments of systems for spine alignment and decompression will be described more fully hereinafter with reference to the accompanying drawings, in which example systems for spine alignment and decompression are shown. Systems for spine alignment and decompression may, however, be embodied in many different forms and should not be construed as limited to the example embodiments set forth herein. Rather, these example embodiments are provided so that this disclosure will be thorough and complete, and will fully convey the scope of systems for spine alignment and decompression to those of ordinary skill in the art. Like, but not necessarily the same, elements (also sometimes called components) in the various figures are denoted by like reference numerals for consistency.

Terms such as "first", "second", "length", "width", "height", "thickness", "top", "bottom", "side", "proximal", "distal", "inner", and "outer" are used merely to distinguish one component (or part of a component or state of a component) from another. Such terms are not meant to denote a preference or a particular orientation. Also, the names given to various components described herein are descriptive of one embodiments and are not meant to be limiting in any way. Those of ordinary skill in the art will appreciate that a feature and/or component shown and/or described in one embodiment (e.g., in a figure) herein can be used in another embodiment (e.g., in any other figure) herein, even if not expressly shown and/or described in such other embodiment.

Figure 1B:
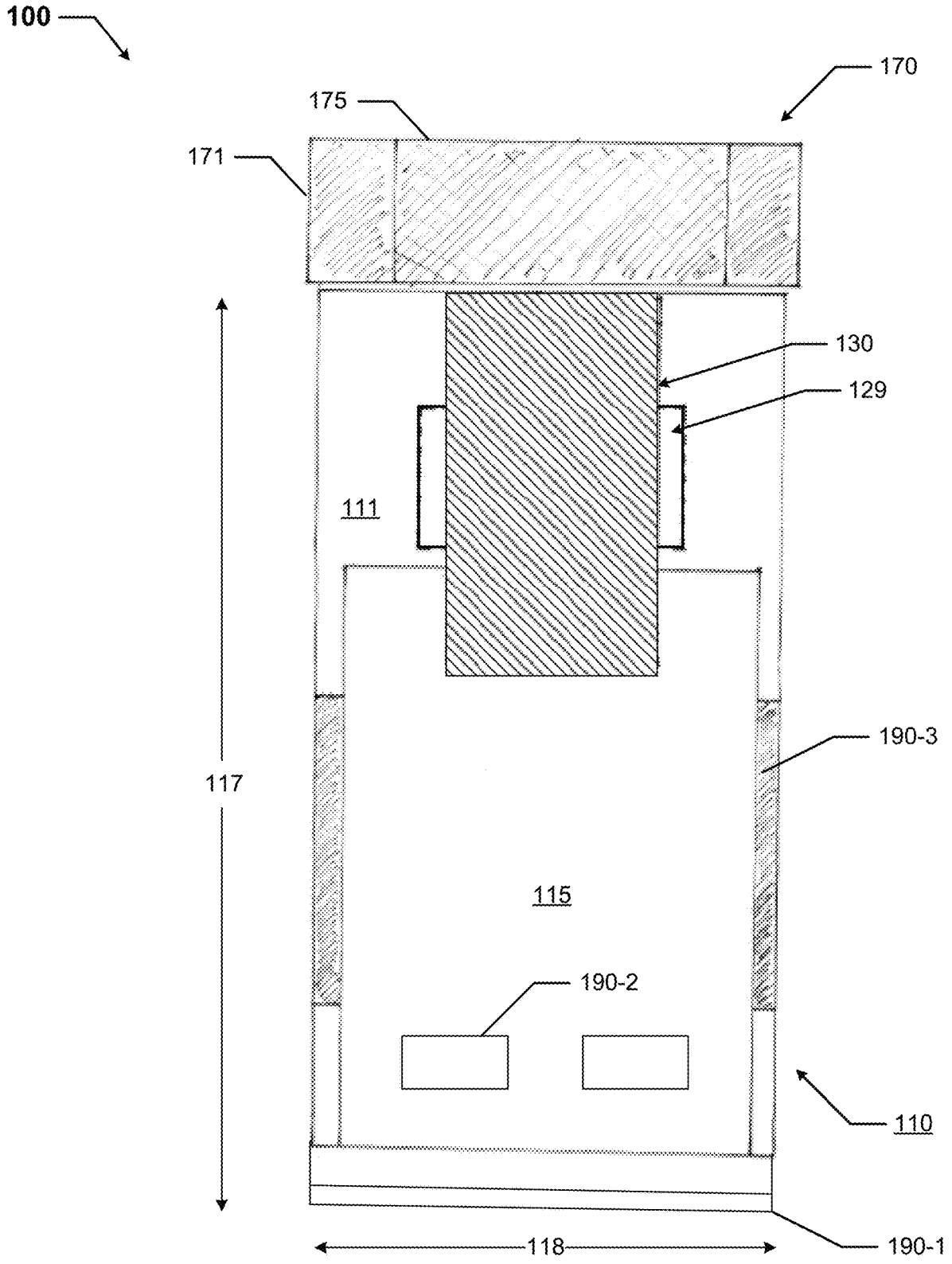
Figure 1D:
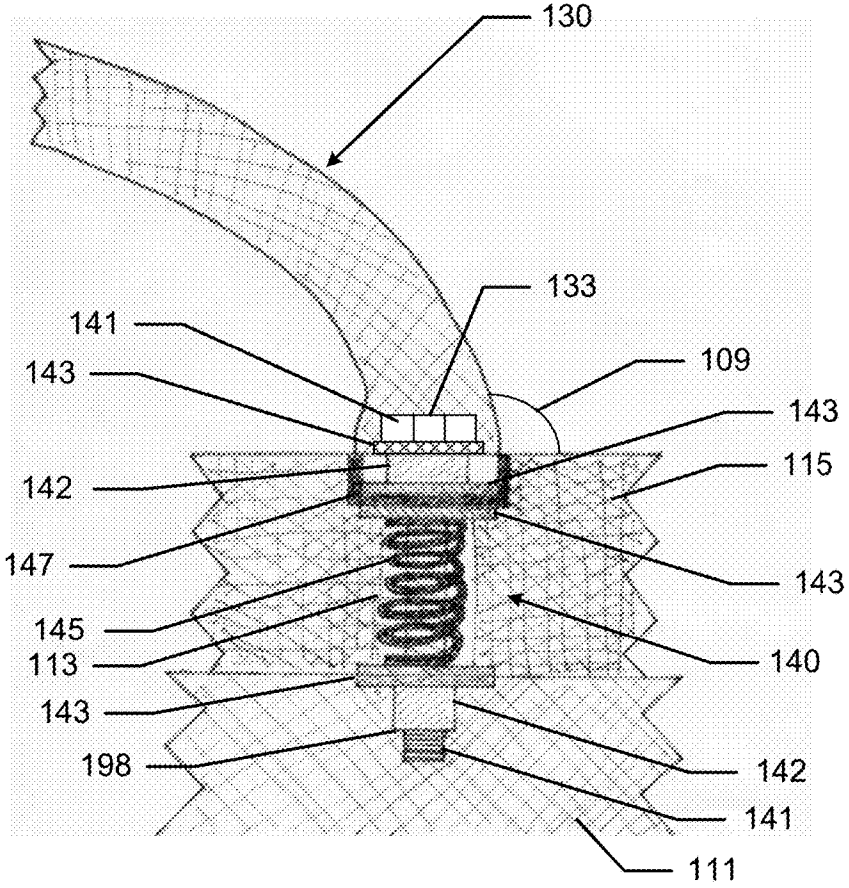
Figure 1C:
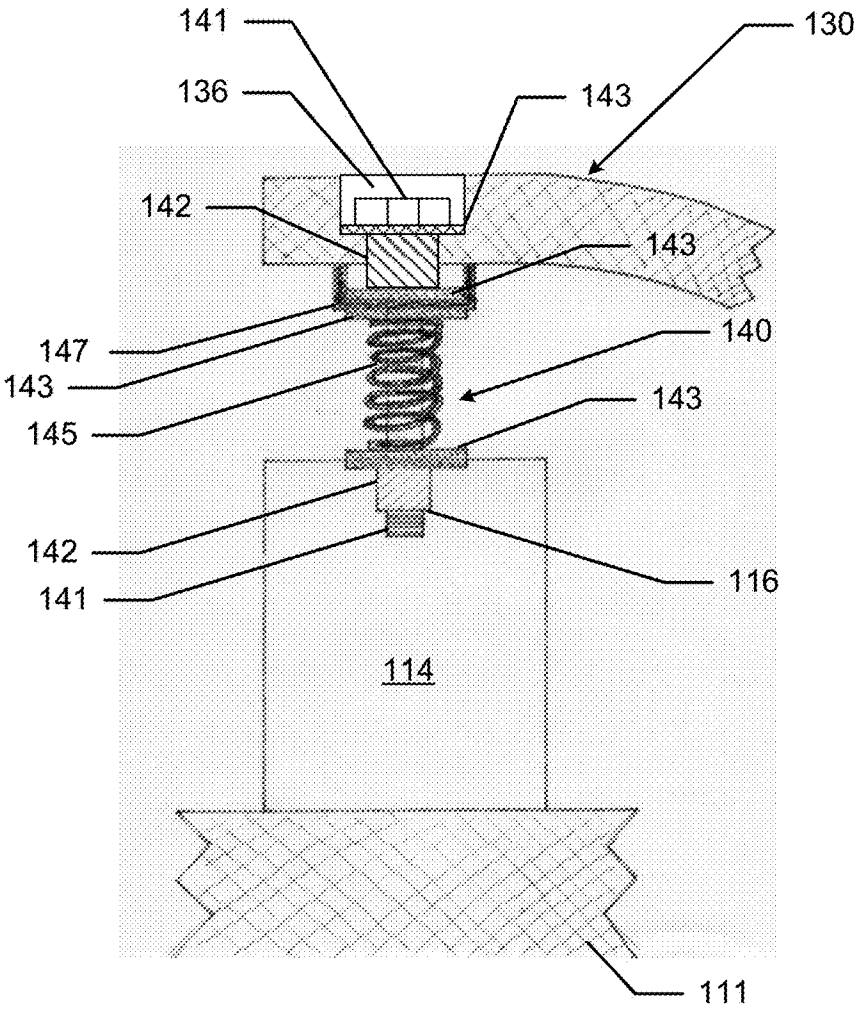
Figure 1E:
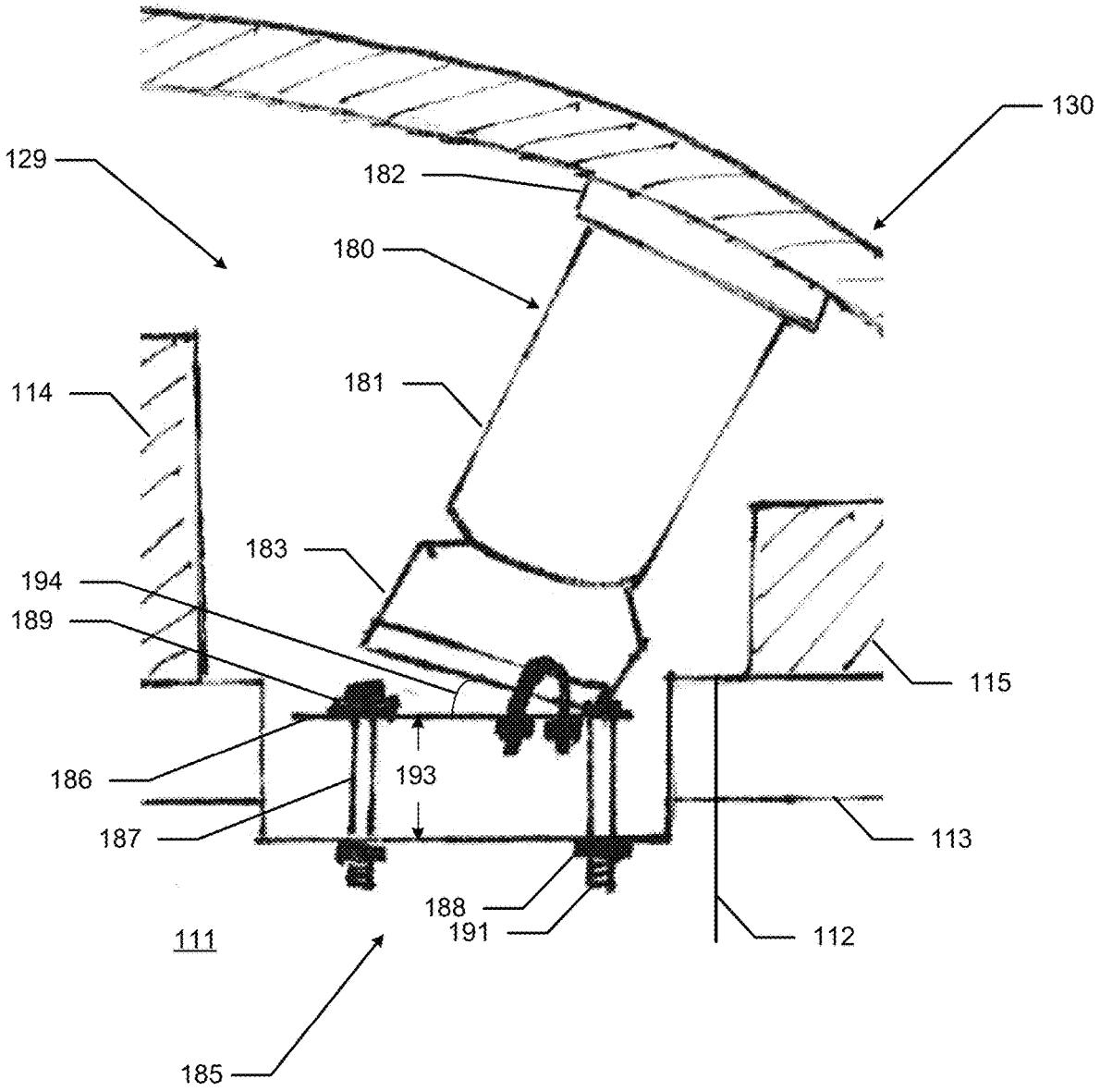

FIGS. 1A-1E show various views of an example system 100 in accordance with certain example embodiments. Specifically, FIG. 1A shows a semi-cross-sectional side view of the system 100 with a human body 150 positioned atop the system 100. FIG. 1B shows a top view of the system 100, without the human body 150. FIGS. 1C-1E show details of the system 100. The example system 100 is used to decompress and align the spine of a human body 150, which in this example is positioned in such a way as to use the system 100. This human body 150 of FIG. 1A includes a torso 152, a head 151 that extends from a top end of the torso 152, arms 156 that extend from sides of the torso 152 toward the top end, and a lower half 155 (e.g., legs 153, feet 154) that extends from a bottom end of the torso 152.

The example system 100 of FIGS. 1A-1E includes a base 110, a headrest assembly 170, a back platform 130, and a vibrating mechanism 180. The base 110 includes a body 111, a top support platform 114 disposed atop the body 111 at the proximal end of the body 111, a bottom support platform 115 disposed atop the body 111 at the distal end of the body 111, optional mobility features 119, and any of a number (in this case, three) of stabilization features 190.

The body 111 has a height 116, a length 117, and a width 118. In certain example embodiments, the width 118, the height 116 and/or the length 117 can be adjustable. In such a case, the adjustments can be made in one or more of any of a number of ways. For example, as shown in FIG. 1A, the body 111 can have two sections (body section 111-1 and body section 111-2), where one body section (e.g., body section 111-2) is slightly smaller than the other body section (e.g., body section 111-1). In such a case, the body sections can telescopically slide relative to each other along seam 112, allowing the length 117 of the base 100 to be adjusted.

There can be coupling features (e.g., apertures in the body sections and a pin that can be disposed within one aperture in each body section at the desired length, detents in the body sections that align with each other) to secure the length 111 of the base 110, which can be important due to the vibrations generated by the vibrating mechanism 180. There can also be stops built into one or both body sections to limit the range of motion of the body sections relative to each other in one (e.g., longer length, shorter length) or both directions.

If a stop is used to limit the range of motion for a longer length 117, a defeat mechanism can be used to allow the stop to be bypassed to allow access inside one or both body sections for such purposes as maintenance. All of these features for adjusting and securing the width 118, the length 117, and/or the height 116 of the base 110 are merely examples. Those of ordinary skill in the art will appreciate that adjusting and securing the width 118, the length 117, and/or the height 116 of the base 110 can be performed in any of a number of other ways. Further, adjusting and securing the width 118, the length 117, and/or the height 116 of the base 110 can be done manually or automatically (e.g., using motorized components, using a controller).

Some portions of the body 111 of the base 110 can form one or more cavities, inside of which can be located a power supply (e.g., transformer, electronics, inverter, resistor, capacitor, diode) used to receive external system power (as from a wall outlet) and generate power of a type (e.g., alternating current, direct current) and level (e.g., 24V, 120V) that can be used by one or more components (e.g., the vibrating mechanism 180, a controller (discussed below), adjustment mechanisms) of the system 100.

As discussed above, atop the body 111 of the base 110 can be disposed a top support platform 114 and a bottom support platform 115. As shown in FIG. 1C, the bottom of the top support platform 114 is coupled to a top surface of the body 111 of the base 110. Further, the top of the top support platform 114 is coupled to the back platform 130 via at least one coupling feature 116 (in this case, an aperture) and a resilient coupling assembly 140. The various dimensions (e.g., height, length, width) of the top support platform 114 can be adjusted in any of a number of ways as described above with respect to the body 111. The top support platform 114 provides an anchor for the top end of the back platform 130, and the resilient coupling assembly 140 used to couple these components of the system 100 allows for the vibration mechanism 180 to operate without diminishing the integrity of the anchor provided by the top support platform 114 to the top end of the back platform 130.

These adjustment features of the base 110 can also be used to help a human body 150 get atop and dismount from the system 100. For example, the base 110 (or portions thereof) can be lowered and/or tilted (e.g., forward) at an angle so that a human body 150 with mobility issues can safely be positioned atop and/or dismount from the system 100 without putting the human body 150 at unnecessary risk of injury.

The resilient coupling assembly 140 can have any of a number of components (e.g., coupling features) and/or configurations that allow for firm and solid coupling to the top support platform 114 and to the top of the back platform 130 while also allowing for limited motion between the top support platform 114 and the top of the back platform 130. For example, in this case, as shown in FIG. 1C, the resilient coupling assembly 140 can include a bolt 141 that extends through part of the aperture 136 (a coupling feature) that traverses the top of the back platform 130 and an aperture 116 (a coupling feature) in the top of the top support platform 114. The bolt 141 can be rigid or compressible (e.g., using an internal compression spring) along its length. Disposed around the bolt 141 is a resilient device 145, which in this case is a compression spring. A number of washers 143 and nuts 142. Also included in this example is a bracket 147 that maintains the integrity of the coupling to the top of the back platform 130. In some cases, the bracket 147 can be a coupling feature of the back platform 130.

As shown in FIG. 1D, the bottom of the bottom support platform 115 is coupled to a top surface of the body 111 of the base 110 via at least one coupling feature (in this case, aperture 198) in the body 111 of the base 110 and part of a resilient coupling assembly 140. Further, the top of the bottom support platform 115 is coupled to the back platform 130 via at least one coupling feature (in this case, aperture 113) and another part of the resilient coupling assembly 140. The resilient coupling assembly 140 of FIG. 1D can be configured (e.g., same components, same arrangement of components) substantially the same as, or differently relative to, the resilient coupling assembly 140 of FIG. 1C.

The various dimensions (e.g., height, length, width) of the bottom support platform 115 can be adjusted in any of a number of ways as described above with respect to the body 111. The bottom support platform 115 provides an anchor for the bottom end of the back platform 130, and the resilient coupling assembly 140 used to couple these components of the system 100 allows for the vibration mechanism 180 to operate without diminishing the integrity of the anchor provided by the bottom support platform 115 to the bottom end of the back platform 130. The resilient coupling assembly 140 of FIG. 1D can be substantially the same as the resilient coupling assembly 140 described above with respect to FIG. 1C.

In certain example embodiments, at least part of the top surface of the bottom support platform 115 is in direct contact with the lower half 155 of the human body 150 when the system 100 is in use. Some or all of these portions of the top surface of the bottom support platform 115 can include one or more features (e.g., padding, contours) to help add comfort to the human body 150 and/or to help the human body 150 be properly positioned and stabilized with respect to the system 100.

The optional mobility features 119 can be used to more easily move the system 100. The mobility features 119 can include any of a number of components that have any of a number of configurations. For example, as shown in FIG. 1A, the mobility features are wheels with casters that are coupled to a bottom surface of the body 111 proximate to the corners. If the base 110 includes mobility features 119, securing mechanisms (e.g., wheel locks, jacks to lift the base 110) can be used to disable the mobility features 119 when the system 100 is in use to prevent a safety hazard and to increase the effectiveness of the system by stabilizing the system 100 relative to a surface (e.g., a floor, a platform). In some cases, these securing mechanisms can be automatically engaged when the vibrating mechanism receives a signal to operate.

The base 110 can also include a user interface 199 disposed thereon. The user interface 199 can allow for control by a user of one or more aspects of the system 100. For example, user interface 199 can allow a user to control the height, width, angle of tile, length, and/or any other type of adjustment to one or more components (e.g., the back platform 130, the base 110) of the system 100. As another example, the user interface 199 can allow a user to turn on, turn off, and/or control the strength of vibration of the vibrating mechanism 180.

While the user interface 199 is shown in FIG. 1A as being mounted on the side of the base 110, a user interface 199 can take one or more of a number of other forms. For example, a user interface 199 can be a wired or wireless remote control. As another example, a user interface 199 can be a computer that is remotely located from the system 100, allowing for the user (e.g., a chiropractor, a back specialist) to operate the system 100 for a patient (a second user). The user interface 199 can include one or more of a number of components, including but not limited to knobs, buttons, dials, slide bars, and switches.

In certain example embodiments, the user interface 199 is part of, or is communicably coupled to, a controller. Such a controller can include one or more of a number of components. In addition to the user interface 199, examples of such components can include, but are not limited to, a control engine, a communication module, a timer, a power module, an energy metering module, one or more sensors (e.g., monitor for excessive vibration, measure weight), a display, a storage repository, a hardware processor, a memory, a transceiver, an application interface, and a security module. The controller can correspond to a computer system 401 as described below with regard to FIG. 4.

By virtue of these various components of the controller, the controller can perform internal analysis and/or store historical data (e.g., user settings, operational history). The controller can also communicate with one or more external devices (e.g., a computer, a mobile device) associated with a doctor, a medical device, a user, some other entity (e.g., an insurance company), or any combination thereof. Such communication can occur using wired and/or wireless technology. For example, the controller can communicate with a doctor (or other remote entity) to provide real-time information (e.g., angle 109, duration, vibration settings and positioning) regarding a user's use of the system 100. In such a case, the doctor (or a computer of the doctor) can make adjustments to one or more settings while the system 100 is in use.

As another example, the controller can communicate with a MRI machine (or a computer that stores results of a MRI scan performed on the human body 150) so that adjustments (e.g., by the controller, by the MRI machine) can be made to the system 100 to optimize treatment of the human body 150. When particular sensors (e.g., imaging devices) are part of the system 100, then a MRI or doctor in communication with the controller can perform a real-time diagnosis of the human body 150. As another example, the controller can determine, using one or more sensors (e.g., proximity sensors, weight sensors, pressure sensors), whether the human body 150 is properly positioned on the system 100. In such a case, if the human body 150 is not properly positioned on the system 100, then the controller can suspend operation of the system 100 and/or notify the human body 150 as to what must be done to be properly positioned on the system 100.

In certain example embodiments, the controller does not include a hardware processor. In such a case, the controller can include, as an example, one or more field programmable gate arrays (FPGA), one or more integrated-gate bipolar transistors (IGBTs), and/or one or more integrated circuits (ICs). Using FPGAs, IGBTs, ICs, and/or other similar devices known in the art allows the controller (or portions thereof) to be programmable and function according to certain logic rules and thresholds without the use of a hardware processor. Alternatively, FPGAs, IGBTs, ICs, and/or similar devices can be used in conjunction with one or more hardware processors.

In certain example embodiments, the system 100 can include one or more of a number of stabilization features 190. Such stabilization features 190 provide some means of stability (leverage) for the human body 150 laying on and using the system 100 to help ensure that the torso 152 of the human body 150 is properly disposed against the back platform 130. In this case, there are three different types of stabilization features 190. Specifically, there are two stabilization features 190-3 that are handles mounted to either side of the body 111 of the base 110, positioned adjacent to the bottom end of the back platform 130.

FIGS. 1A and 1B also shows two stabilization features 190-2 that are stirrups mounted on the top surface of the bottom support platform 115 toward the distal end of the bottom support platform 115, as well as stabilization feature 190-1 that is a platform mounted on the distal end surface of the body 111 of the base 110. Stabilization features 190-2 and stabilization feature 190-1 are alternatives to each other. Stabilization features 190-2 are configured to receive the feet 154 of the human body 150, as shown in FIG. 1A. Stabilization feature 190-1 is a platform against which the feet 154 of the human body 150 can abut against and push against. Other types of stabilization features 190 can include, but are not limited to, a strap and a belt.

Figure 2:
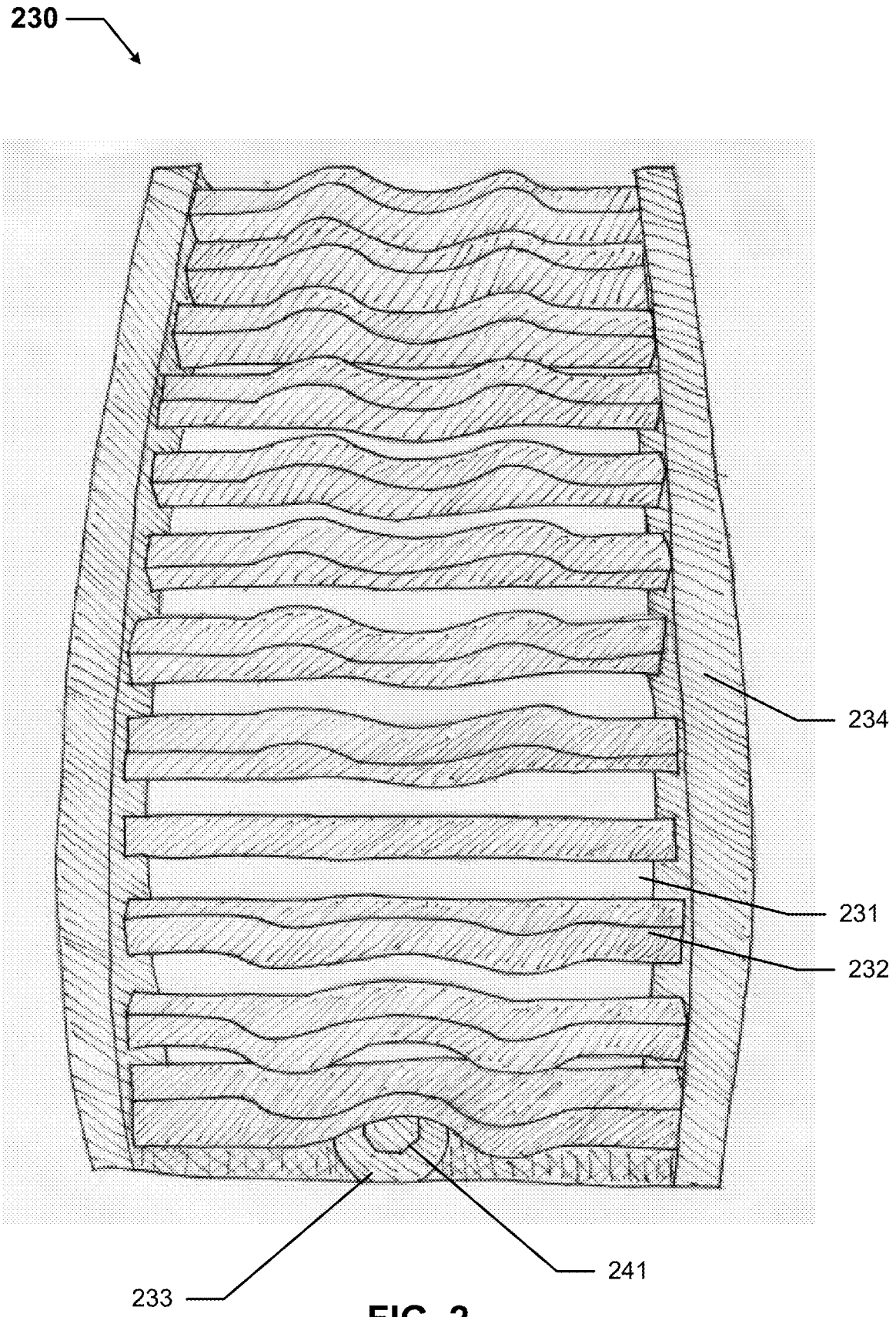
FIG. 2 shows a top view of a back platform in accordance with certain example embodiments.

In certain example embodiments, the back platform 130 supports the back side of the torso 152 of the human body 150. The back platform 130 can have one or more of a number of features and/or configurations. For example, as shown in FIG. 1A, the back platform 130 can have a curvature 138. In some cases, as in this example, the curvature 138 of the back platform 130 is an outward curvature that mirrors the natural curvature of a spine of the human body 150. In some other cases, the curvature 138 of the back platform 130 is exaggerated relative to the natural curvature of a spine of the human body 150. The curvature 138 can be used, at least in part, to help properly decompress and/or align the spine of the human body 150 using the system 100. As another example, the front outer surface of the back platform 130 can be smooth and featureless. Alternatively, as shown in FIG. 2 below, the front outer surface of the back platform 130 can have any of a number of features and/or contours.

The back platform 130 can include multiple coupling features (e.g., apertures, slots, tabs). As shown in FIG. 1C, at least one of these coupling features (e.g., aperture 136, bracket 147) can be used to help couple the top end of the back platform 130 directly to a resilient coupling assembly 140 and indirectly to the top support platform 114. As discussed above, the resilient coupling assembly 140 acts as a type of shock absorber, allowing the top end of the back platform 130 to remain coupled to the top support platform 114 while being subjected to vibrations generated by the vibrating mechanism 180.

Similarly, as shown in FIG. 1D, at least one other of these coupling features (e.g., aperture 133, bracket 147) can be used to help couple the bottom end of the back platform 130 directly to a resilient coupling assembly 140 and to the bottom support platform 115. As discussed above, the resilient coupling assembly 140 acts as a type of shock absorber, allowing the bottom end of the back platform 130 to remain coupled to the bottom support platform 115 (and indirectly to the body 111 of the base 110) while being subjected to vibrations generated by the vibrating mechanism 180.

The various coupling features of the back platform 130, the top support platform 114, the bottom support platform 115, and/or the body 111 of the base 110, as well as the resilient coupling assemblies 140, can be configured in such a way that the back platform 130 can be easily removable and replaceable. This modular approach with respect to the back platform 130 allows for people of different sizes and/or contour requirements (e.g., curvature) for the back platform 130 to use the same system 100 by merely installing the appropriate back platform 130 for each user. Depending on the configuration, removing and/or installing a back platform 130 can be performed with or without the use of tools.

The angle 109 that the back platform 130 forms with the body 111 of the base 110 can be adjustable. For example, by adjusting the height of the top support platform 114 (as described above) relative to the bottom support platform 115, the angle 109 formed between the back platform 130 and the body 111 of the base 110 can be adjusted.

In certain example embodiments, the vibrating mechanism 180 generates vibrations, which are transmitted directly or indirectly to the back platform 130 when the vibrating mechanism 180 operates. In this example, the vibrating mechanism 180 abuts against some portion of the rear outer surface of the back platform 130 and thereby transmits the vibrations to the back platform 130. The vibrations generated by the vibrating mechanism 180 can have one or more of any of a number of characteristics, including but not limited to hard, soft, pounding, oscillating, constant, and intermittent.

The vibrating mechanism 180 can have any of a number of components and/or configurations. For example, as shown in FIGS. 1A and 1E, the vibration mechanism 180 can be disposed within a cavity 129 formed between the back platform 130, the top support platform 114, the bottom support platform 115, and the body 111 of the base 110. The vibrating mechanism 180 in this case has a head 182, a body 181, and a base 183. The head 182 abuts against the rear outer surface of the back platform 130. The body 181 is disposed between the head 182 and the base 183 and can include a motor, controls, and/or other components that mechanically generate (or initiate generation of) the vibrations. The base 183 of the vibrating mechanism 180 in this case is used to position the vibrating mechanism 180 in a particular orientation relative to a mounting frame 185 and the back platform 130.

The mounting frame 185 is coupled to the body 111 of the base 110 using one or more coupling features (e.g., bolts 187, nuts 188, apertures 191). In addition to the coupling features (e.g., bolts 187, nuts 188, washers 189), the mounting frame 185 can include one or more mounting plates 186 that can adjust the height 193 and/or angle of tilt 194 of the vibrating mechanism 190 within the cavity 129. The mounting assembly 180 can be configured to allow for adjustments to be made and secured without the use of tools.

In certain example embodiments, the headrest assembly 170 supports the head 151 of the human body 150 while the system 100 operates. The headrest assembly 170 can include any of a number of components and have any of a number of configurations. In this case, the headrest assembly 170 includes a body 171, atop of which is disposed a headrest 175. In some cases, the headrest assembly 170 is integrated with the base 110. In other cases, such as in this example, the headrest assembly 170 is coupled to the base 110, but is otherwise independent of the base 110. The height of the headrest 175 can be adjustable. An example of another the headrest assembly is shown below with respect to FIG. 3.

In certain example embodiments, vibrations generated by the vibrating mechanism 180 can be translated to the headrest 175 of the headrest assembly 170. Such a capability can be inherent in the system 100, or in the alternative, such a capability can be engaged by manipulating certain features (e.g., coupling features between the base 110 and the headrest assembly 170).

FIG. 2 shows a top view of a back platform 230 in accordance with certain example embodiments. Referring to FIGS. 1A-2, the back platform 230 of FIG. 2 is substantially the same as the back platform 130 of FIGS. 1A-1E, except as described below. The back platform 230 includes a number of protrusions 232 (e.g., ribs) mounted on the top outer surface 231. These protrusions 232 are disposed substantially horizontally along most of the width of the back platform 230, and are bounded by substantially vertical side protrusions 234, which traverse the entire height of the back platform 230 on both sides of the back platform 230. The protrusions 232 can also be configured (e.g., form a channel) to keep the spine centered along the height of the back platform 230.

Further, the back platform 230 is contoured in that the width of the back platform 230 varies along its height. Such features of a back platform 230 can be specifically designed for a particular individual having particular spinal characteristics (e.g., height, age, actual curvature of the spine relative to an ideal curvature of the spine, horizontal displacement (e.g., as from a condition like scoliosis), fused disks). In addition, The aperture 233 (a coupling feature) that traverses the thickness of the back platform 230 and receives the bolt 241 of a resilient coupling assembly (e.g., resilient coupling assembly 140).

Figure 3:
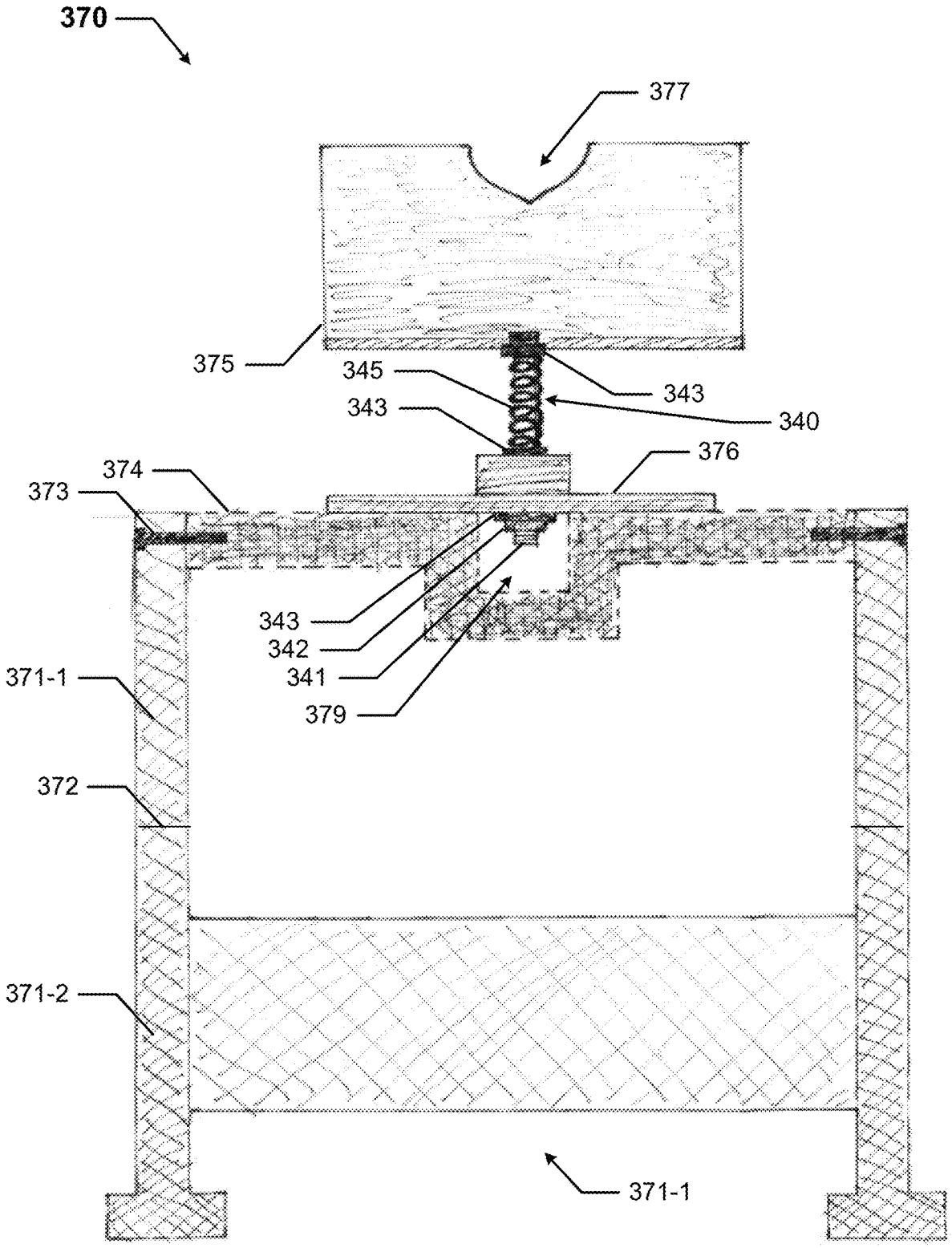
FIG. 3 shows a headrest assembly in accordance with certain example embodiments.

FIG. 3 shows a headrest assembly 370 in accordance with certain example embodiments. Referring to FIGS. 1A-3, the headrest assembly 370 of FIG. 3 is substantially the same as the headrest assembly 170 of FIGS. 1A-1E, except as described below. In this case, the body 371 of the headrest assembly 370 has two sections (body section 371-1 and body section 371-2), where one body section (e.g., body section 371-1) is slightly smaller than the other body section (e.g., body section 371-2). In such a case, the body sections can telescopically slide relative to each other along seam 372, allowing the height of the headrest assembly 370 (and so also the headrest 375) to be adjusted.

There can be coupling features (e.g., apertures in the body sections and a pin that can be disposed within one aperture in each body section at the desired length, detents in the body sections that align with each other) to secure the body sections relative to each other, thereby securing the height of the headrest assembly 370. These coupling features can be designed to keep the height of the headrest assembly 370 fixed, even when exposed to the vibrations generated by the vibrating mechanism. There can also be stops built into one or both body sections to limit the range of motion of the body sections relative to each other in one (e.g., greater height, lesser height) or both directions.

If a stop is used to limit the range of motion for a greater height, a defeat mechanism (e.g., a release) can be used to allow the stop to be bypassed to allow access inside one or both body sections for such purposes as maintenance. Similarly, the width and/or the length 117 of the headrest assembly 370 can be adjusted. These means of adjusting the height of the headrest assembly 370 is merely an example. Those of ordinary skill in the art will appreciate that adjusting and securing the width, the length, and/or the height of the headrest assembly 370 can be performed in any of a number of other ways. Further, adjusting and securing the width, the length, and/or the height of the headrest assembly 370 can be done manually or automatically (e.g., using motorized components, using a controller).

The headrest 375 of FIG. 3 can additionally or alternatively be adjusted in one or more other ways. For example, as shown in FIG. 3, a horizontal member 374 of the headrest assembly 370 can be rotatably coupled to body section 371-1 of the body 371 using coupling features 373, which in this case are pins that traverse a thickness of body section 371-1 and part of the horizontal member 374. The headrest is indirectly coupled to the horizontal member 374, and so as the horizontal member 374 rotates relative to the body 371, the headrest 375 also rotates.

As shown in FIG. 3, the horizontal member 374 can have type of U-shape that forms a channel 379 along the center of its length. Disposed within the channel 379 can be disposed part of a resilient coupling assembly 340. Such a resilient coupling assembly 340 can also traverse a mounting member 376 and also be disposed in a bottom part of the headrest 375. As shown in FIG. 3, a resilient member 345 (e.g., a coil spring) of the resilient coupling assembly 340 can be disposed between the mounting member 376 and the headrest 375. The mounting member 376 and the headrest 375 can have one or more coupling features (e.g., apertures) that allow these components to be coupled to the resilient coupling assembly 340. The resilient coupling assembly 340 can be used to support the weight of a head (e.g., head 151) of a human body (e.g., human body 150) and allow vibrations applied to the spine that translate to the head to dissipate. The resilient coupling assembly 340 can be substantially the same as the resilient coupling assemblies 140 described above with respect to FIGS. 1A-1E.

The mounting member 376 of the headrest assembly 370 can be fixedly coupled to the horizontal member 374 using one or more of a number of coupling features (e.g., apertures, bolts 341, nuts 343, washers 342). Alternatively, the mounting member 376 of the headrest assembly 370 can be moveably coupled to the horizontal member 374 using one or more of a number of coupling features (e.g., slots, tabs, detents, set screws). In such a case, the movement of the mounting member 376 relative to the horizontal member 374 can be in any of a number of directions.

For example, the mounting member 376 can move along the length of the base (e.g., base 110) of a system relative to the horizontal member 374. Put another way, the mounting member 376 can move into and out of the page relative to the horizontal member 374 as shown in FIG. 3. In certain example embodiments, the top of the headrest 375 of the headrest assembly 370 can be contoured, leaving a channel 377 for the head and/or neck of a human body to be disposed while the system operates. The various characteristics (e.g., shape, size, texture) of the channel 377 can vary.

Figure 4:
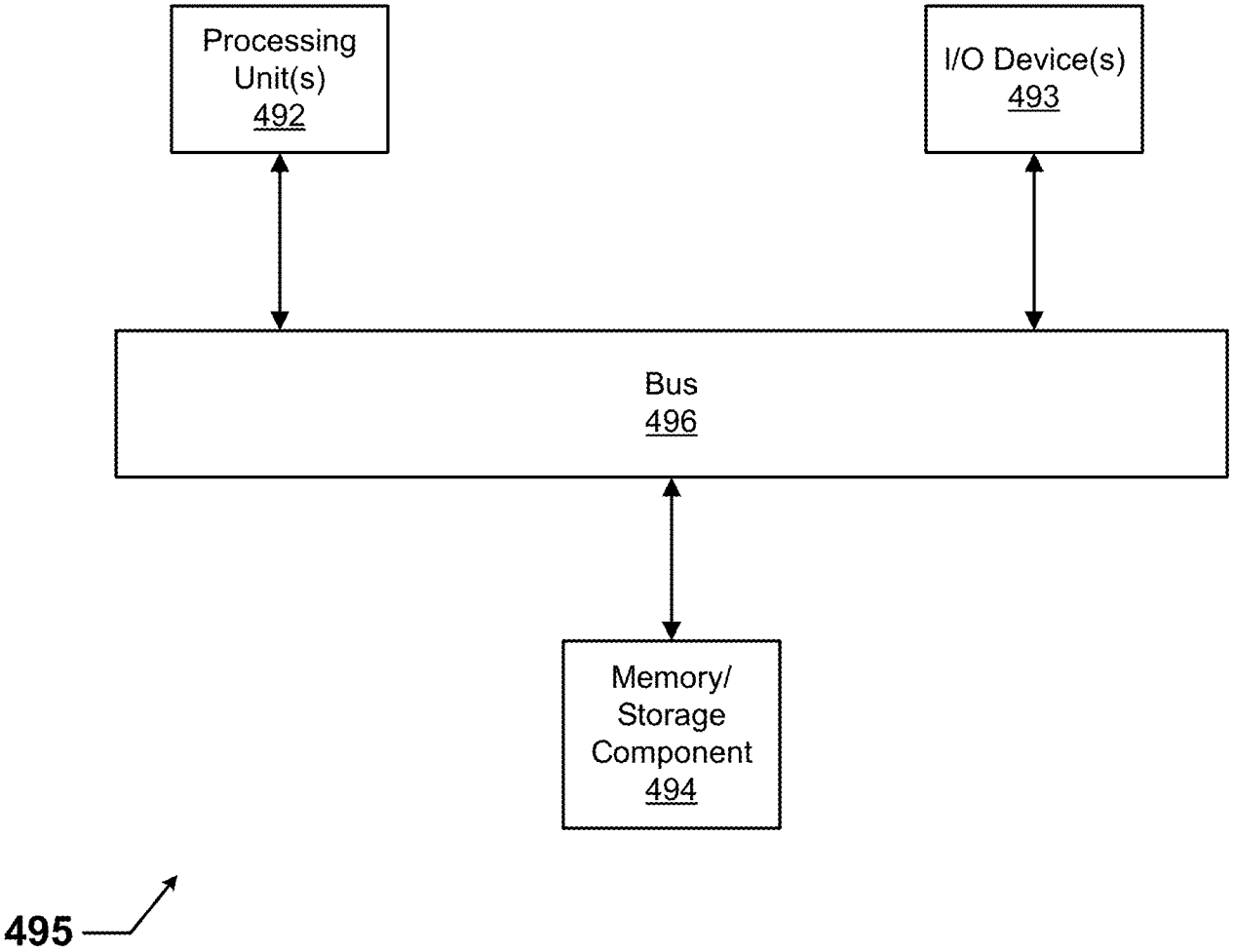
FIG. 4 shows a computer system in accordance with certain example embodiments.

FIG. 4 illustrates one embodiment of a computing device 495 that implements one or more of the various techniques described herein, and which is representative, in whole or in part, of the elements described herein pursuant to certain exemplary embodiments. Computing device 495 is one example of a computing device and is not intended to suggest any limitation as to scope of use or functionality of the computing device and/or its possible architectures. Neither should computing device 495 be interpreted as having any dependency or requirement relating to any one or combination of components illustrated in the example computing device 495.

Computing device 495 includes one or more processors or processing units 492, one or more memory/storage components 494, one or more input/output (I/O) devices 493, and a bus 496 that allows the various components and devices to communicate with one another. Bus 496 represents one or more of any of several types of bus structures, including a memory bus or memory controller, a peripheral bus, an accelerated graphics port, and a processor or local bus using any of a variety of bus architectures. Bus 496 includes wired and/or wireless buses.

Memory/storage component 494 represents one or more computer storage media. Memory/storage component 494 includes volatile media (such as random access memory (RAM)) and/or nonvolatile media (such as read only memory (ROM), flash memory, optical disks, magnetic disks, and so forth). Memory/storage component 494 includes fixed media (e.g., RAM, ROM, a fixed hard drive, etc.) as well as removable media (e.g., a Flash memory drive, a removable hard drive, an optical disk, and so forth).

One or more I/O devices 493 allow a customer, utility, or other user to enter commands and information to computing device 495, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 495 is connected to a network (not shown) (e.g., a local area network (LAN), a wide area network (WAN) such as the Internet, cloud, or any other similar type of network) via a network interface connection (not shown) according to some exemplary embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other exemplary embodiments. Generally speaking, the computer system 495 includes at least the minimal processing, input, and/or output means necessary to practice one or more embodiments.

Further, those skilled in the art will appreciate that one or more elements of the aforementioned computer device 495 is located at a remote location and connected to the other elements over a network in certain exemplary embodiments. Further, one or more embodiments is implemented on a distributed system having one or more nodes, where each portion of the implementation (e.g., controller) is located on a different node within the distributed system. In one or more embodiments, the node corresponds to a computer system. Alternatively, the node corresponds to a processor with associated physical memory in some exemplary embodiments. The node alternatively corresponds to a processor with shared memory and/or resources in some exemplary embodiments.

Example embodiments provide a system for providing treatment to the back of a human body. More specifically, example embodiments can assist in aligning and/or decompressing the spine of a human body by setting the spine against a back platform having the natural curvature of the spine and applying vibrations to the back platform using a vibrating mechanism. Example embodiments can be adjustable ergonomically (e.g., height, angle of back platform relative to base, curvature of back platform) and operationally (e.g., settings and placement of vibrating mechanism). Example embodiments can be mobile or placed in a fixed position. Example embodiments can be designed to comply with any of a number of applicable professional and/or safety standards. Example embodiments can include a controller that can automate certain functions, track usage, record user preferences, and perform a number of other functions to improve the user experience in using the system.

Example embodiments provide a number of benefits. Examples of such benefits include, but are not limited to, ease of use, ease of changing settings and/or back platforms (modularity), low maintenance, portability, and increased strength, flexibility, and/or overall health of a user. Example embodiments can also be used to augment existing wellness plan of a user.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A system comprising:

a base comprising a first section and a second section, wherein the second section of the base is elevated relative to the first section of the base, wherein the first section comprises:

a planar top surface that is configured to support a buttocks and feet of a human body; and at least one foot stabilization feature that is configured to receive the feet of the human body;

a headrest assembly comprising a headrest that is elevated relative to the first section of the base, wherein the headrest is disposed adjacent to the second section of the base, wherein the headrest is configured to support a head of the human body;

a single back platform comprising a single convex curved surface, wherein the single convex curved surface is configured to support a torso of the human body and is configured to face and support a back of the human body, wherein the single convex curved surface is configured to correspond to a curvature of a spine of the human body, wherein the single back platform has a first end that is coupled to the first section of the base and a second end that is coupled to the second section of the base, wherein the single convex curved surface extends from the first end to the second end of the single back platform, wherein the second end of the single back platform is elevated relative to the first end of the single back platform, wherein the second end of the single back platform is adjacent to the headrest, and wherein the at least one foot stabilization feature, when engaged by the feet of the human body, allows the human body to force a lower portion of the back of the human body against the first end of the single back platform; and a vibrator in communication with the back platform, wherein vibrations generated by the vibrator translate to the single back platform, wherein the vibrator abuts against a rear surface of the single back platform, and wherein the vibrator is adjustable to allow the vibrator to be placed at different locations along the rear surface of the single back platform.

2. The system of claim 1, wherein the first end of the single back platform is coupled to the first section of the base using a first resilient device, and wherein the second end of the single back platform is coupled to the second section of the base using a second resilient device.

3. The system of claim 1, wherein the headrest assembly has a movable portion that is configured to be positioned to receive the head of the human body.

4. The system of claim 1, wherein the single back platform and the base form a cavity, wherein the vibrator is disposed within the cavity.

5. The system of claim 1, further comprising:

a controller that controls the vibrator.

6. The system of claim 5, wherein the controller comprises a user interface that is accessible when the human body is supported by the base, the headrest, and the single back platform.

7. The system of claim 5, wherein the controller further controls a position of the vibrator relative to the single back platform.

8. The system of claim 1, wherein the base comprises at least one handle that is configured to stabilize a lower half of the human body.

9. The system of claim 1, wherein the base comprises a mobility feature that allows a user to move the base, the headrest, the single back platform, and the vibrator.

10. The system of claim 9, wherein the mobility feature comprises a locking mechanism that is engaged when the vibrator operates.

11. The system of claim 1, wherein the single back platform is replaceable relative to the base.

12. The system of claim 1, wherein the base has a length that is adjustable.

13. The system of claim 1, wherein the headrest has a height that is adjustable.

14. The system of claim 1, wherein the single back platform forms an angle of incline relative to the base, wherein the angle of incline is adjustable.

15. The system of claim 1, wherein the planar top surface of the first section of the base is horizontal relative to a ground surface on which the base is disposed.

* * * * *